US005140919A

United States Patent [19]

Bevington

[11] Patent Number: 5,140,919

[45] Date of Patent: Aug. 25, 1992

[54] METHOD FOR MANUFACTURING TEE SHIRTS FROM TUBULAR BLANKS INCLUDING FASTENING BLANKS IN REGISTRY DURING FINISHING STEPS

[76] Inventor: Charles E. Bevington, 554 Gilbertsville Rd., Gilbertsville, Pa. 19525

[21] Appl. No.: 547,452

[22] Filed: Jul. 3, 1990

[51] Int. Cl.[5] ..... D05B 33/00; D05B 35/10; D05B 39/00; D05B 25/00

[52] U.S. Cl. ..... 112/262.3; 112/141; 112/155; 112/121.29; 198/680; 2/243 R

[58] Field of Search ..... 112/262.3, 265.1, 262.1, 112/121.15, 121.11, 121.29, 141, 143, 104, 148, 63, 155; 2/243 R, 243 B, 113

[56] References Cited

U.S. PATENT DOCUMENTS

| | | | |
|---|---|---|---|
| 2,264,032 | 11/1941 | Webb | 112/262.3 |
| 2,492,925 | 12/1949 | Segur | 2/243 R |
| 3,257,978 | 6/1966 | Haddad | 112/121.15 |
| 3,295,483 | 1/1967 | Rothfuss et al. | 112/2 |
| 3,664,282 | 6/1972 | Wagar | 112/121.15 |
| 3,675,604 | 7/1972 | Frost | 112/121.29 X |
| 4,214,541 | 7/1980 | Zeigler, Jr. et al. | 112/262.3 |
| 4,299,179 | 11/1981 | Helffer et al. | 112/262.3 X |
| 4,343,255 | 8/1982 | Kelly et al. | 112/262.3 |
| 4,526,115 | 7/1985 | Kosrow et al. | 112/141 X |
| 4,640,207 | 2/1987 | O'Keefe et al. | 112/121.29 X |
| 4,756,261 | 7/1988 | Gershoni | 112/121.12 X |
| 4,952,203 | 8/1990 | Rouleau et al. | 112/262.3 X |

*Primary Examiner*—Peter Nerbun

*Attorney, Agent, or Firm*—Eckert Seamans Cherin & Mellott

[57] ABSTRACT

Tee shirts are manufactured from tubular blanks while retained in a fastened stack and transported from station to station for completion of finishing operations. The blanks have bottom ends and two opposite shoulders, the process including stacking a group of tubular blanks in registry with corresponding bottom ends and shoulder locations of successive tubular blanks disposed over one another in a stack. The bottom edges can be preliminarily hemmed. The stack is attached via a fastener which detachably engages an overhead conveyor. The fastener is attached at the hemmed bottom end such that the tee shirt blanks in the stack remain in registry as they are processed and recover their registry when hung from the conveyor in a stack after a finishing step. The successive finishing operations at each station are accomplished by processing an endmost tee shirt blank in the stack, clearing the endmost blank and processing the next endmost blank until all the blanks in the stack have had that finishing operation completed. The attached stack is then moved on the conveyor to a next finishing station, and so on until completion.

16 Claims, 2 Drawing Sheets

FIG. 1
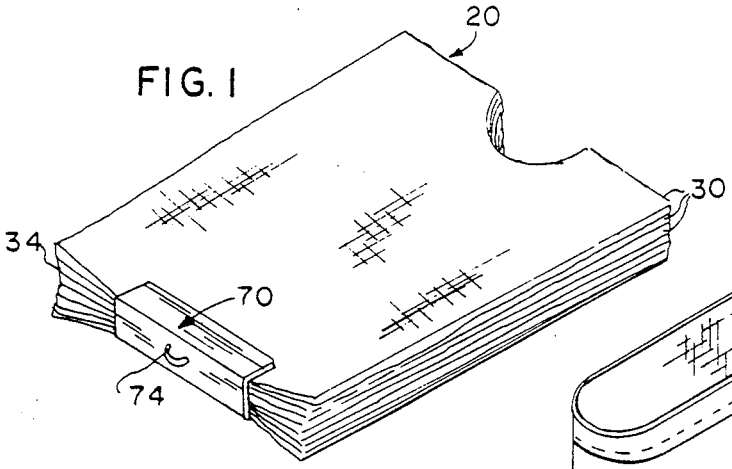
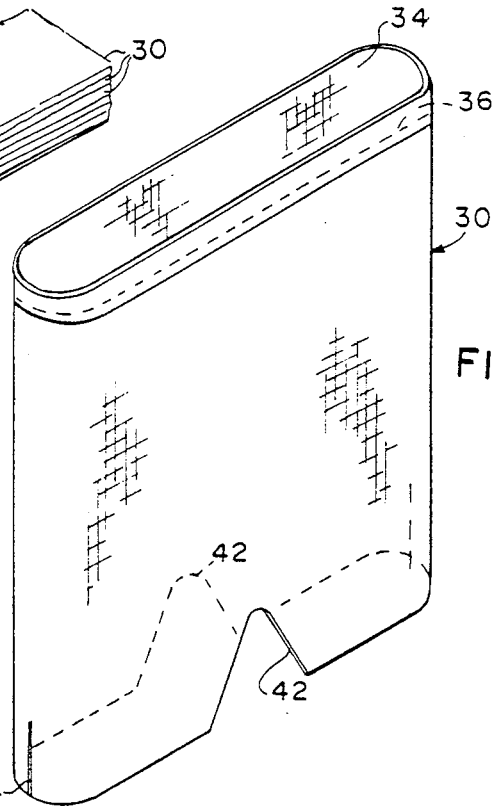
FIG. 2
FIG. 3
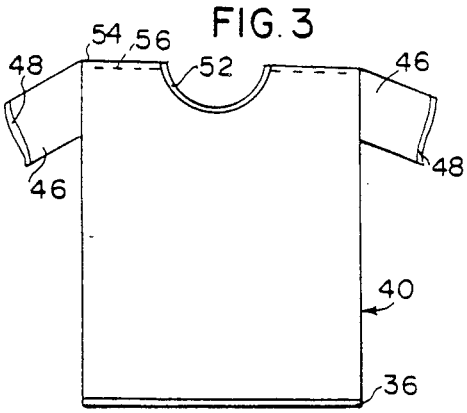
FIG. 4
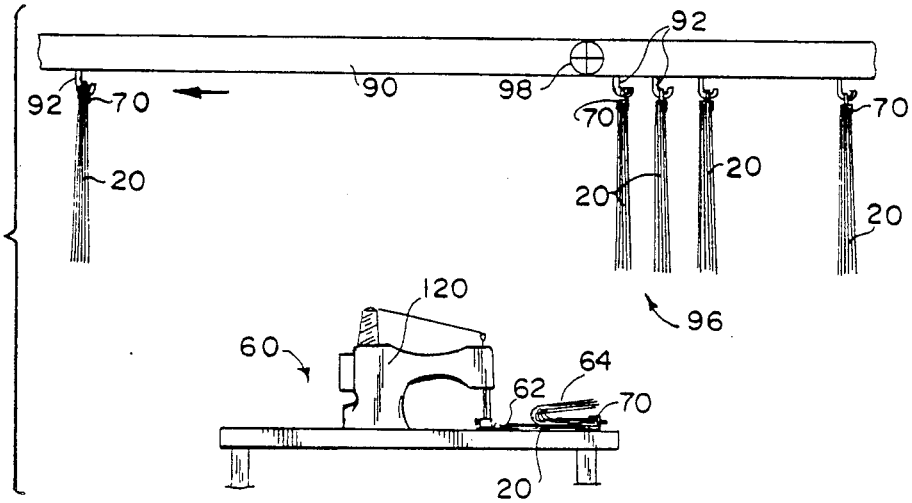

METHOD FOR MANUFACTURING TEE SHIRTS FROM TUBULAR BLANKS INCLUDING FASTENING BLANKS IN REGISTRY DURING FINISHING STEPS

BACKGROUND OF THE INVENTION

1. Field of the Invention

This invention relates to the field of garment manufacture wherein a number of garment preforms or blanks are to be processed through successive finishing steps toward completion of finished garments. In particular, the invention concerns an improvement wherein the blanks are retained in a clamp or fastener throughout processing, the clamp being a removable trolley element attachable to a carriage on an overhead conveyor.

2. Prior Art

Garment manufacture is most efficient when conducted as an assembly line operation. Beginning as flat stock or as preforms or blanks, the garments are successively processed through successive steps, during which successive procedures such as hemming, attachment of separate parts and similar finishing operations are accomplished to convert each of the preforms or blanks, together with the respective separate parts attached thereto, into completed garments.

When handling blanks brought individually to a processing station, the operator must as a preliminary matter find the respective location on the blank at which the particular sewing operation is to be conducted. This may involve turning the blank to find a particular edge, rotating the blank to place the required edge in correct orientation for feeding into the sewing machine, smoothing opposed surfaces to be attached, etc. It is possible as in U.S. Pat. No. 2,492,925 —Segur to string together individual blanks by attaching each one to a continuous line, and thereby reduce the number or complexity of positioning steps which are needed to get each individual blank into the position needed. However, the blanks are handled serially and the attachment, detachment and handling of the line are steps which are added to the sewing processes and might advantageously be deleted.

The individual finishing steps in a sewing operation production line can be most efficiently completed using special purpose sewing machines adapted to each particular operation, and these machines and/or the character of the work stations at which they are operated may vary considerably if the work stations along the production line are outfitted specifically for different operations. A hemming operation to be conducted at an edge of a tubular blank, for example, can be most efficiently accomplished using a different type of sewing machine or machine station than would be most efficient for attachment of a reinforcing strip along the inside of a seam. Therefore, the blanks are moved from one processing station to another, one or more specific operations being performed at a given station for all the blanks in turn.

The garments or preforms passing through a manufacturing operation accordingly must be moved from station to station. In U.S. Pat. No. 2,264,032 —Webb, an overhead conveyor is disclosed as a means to carry garments which have been processed at one station in a manufacturing operation to the next station. The overhead conveyor includes garment engaging fixtures for each successive garment. A benefit of conveyors of this kind is that the fixtures and the garments they carry can queue up at each station, allowing each operator to work at his or her own pace, rather than at the continuous speed of a linear conveyor or attached string of articles. An inherent drawback, however, is that since the garments or preforms are serially processed one at a time, each must be individually suspended from the conveyor, detached and individually positioned before commencing processing. Efficiencies that could result from handling a stack of garments at the same time are not realized.

SUMMARY OF THE INVENTION

It is an object of the invention to improve the efficiency of production of garments and the like, by preliminarily affixing the garments in aligned stacks and thereafter performing production steps while retaining the individual garments in alignment in the stacks.

It is another object of the invention to apply an endless loop overhead conveyor to the production of garments in groups, with a fastener applied to a group of aligned garments providing the means for mounting on the conveyor and thus retaining the grouping and alignment of the garments through a series of production steps.

These and other objects are accomplished by a process for manufacturing garments and the like, and in particular tee shirts from tubular blanks, while retaining the blanks in a fastened stack and transporting the stack from station to station for completion of finishing operations. In connection with tee shirts the blanks have bottom ends and two opposite end shoulders, the process including stacking a group of tubular blanks in registry with corresponding bottom ends and shoulder locations of successive tubular blanks disposed over one another in a stack. The bottom edges can be preliminarily hemmed. The stack is attached via a fastener which forms a means for carrying the stack on a transporting mechanism, in particular an overhead conveyor. The fastener is attached at the hemmed bottom end such that the tee shirt blanks in the stack remain in registry as they are processed and between processing stations recover their registry due to gravity when hung from the conveyor. The successive finishing operations at each station are accomplished by processing an endmost tee shirt blank in the stack, turning it back or pushing it aside and processing the next endmost blank until all the blanks in the stack have had that finishing operation completed, the fastener remaining on the stack throughout. The attached stack is then replaced on the conveyor and moved to a next finishing station, and so on until completion.

BRIEF DESCRIPTION OF THE DRAWINGS

There are shown in the drawings the embodiments of the invention as presently preferred. It should be understood, however, that the invention is not limited to the exemplary embodiments shown, and is subject to variations in accordance with the scope of the invention as disclosed and claimed. In the drawings, FIG. 1 is a perspective view of a stack of aligned tee shirt blanks in accordance with the invention;

FIG. 2 is a perspective view of a single tee shirt blank;

FIG. 3 is a front elevation view of a finished tee shirt;

FIG. 4 is a partial elevation view of a processing station passed by a conveyor according to the invention;

DETAILED DESCRIPTION OF THE PREFERRED EMBODIMENTS

Figure 5:
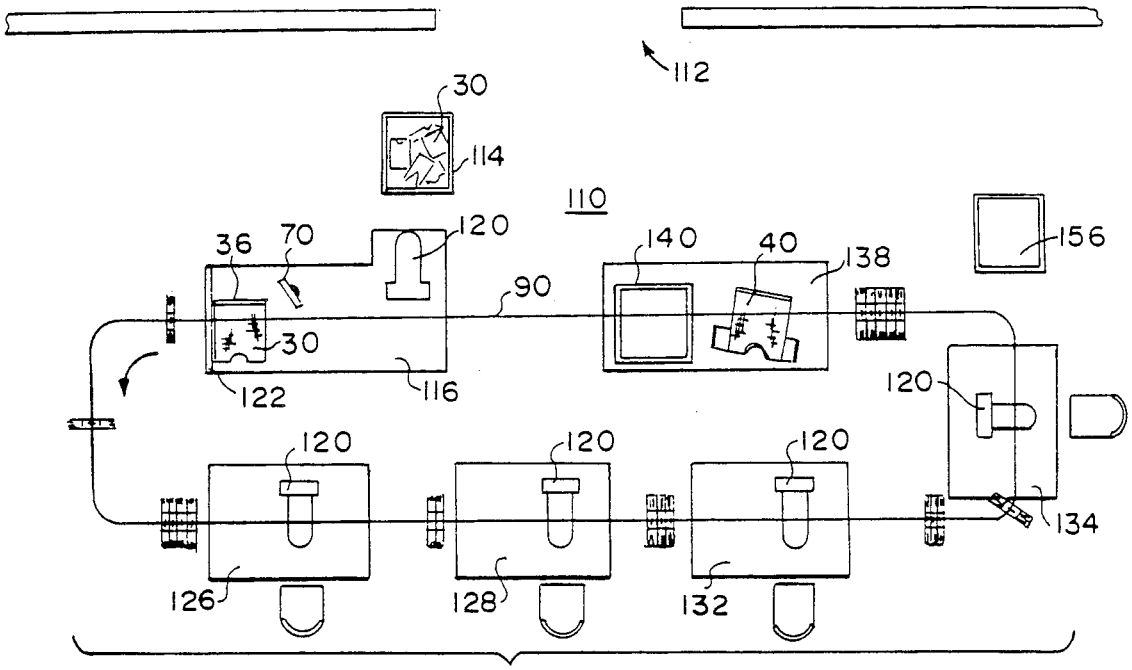
FIG. 5 is a schematic plan view of a production facility for manufacture of tee shirts or the like; and, FIG. 6 is a perspective view of a spring clip for use according to the invention.

According to the invention, the manufacture of garments through a series of progressive steps leading from preforms to finished garments, is facilitated by attaching the preforms together in aligned stacks, and processing the entire stack as an integral unit through the successive steps. As each stack is received at a finishing station, the individual blanks in the stack are processed in turn, without ever detaching the individual blanks from the stack. Inasmuch as the preliminary alignment and continuous attachment of the blanks ensures that the successive individual blanks in a stack all are in the same alignment relative to the stack, the usual need to find a location on the garment blank and to align the garment blank to the sewing machine before commencing a finishing operation is substantially reduced.

The invention is generally applicable to manufacturing garments from blanks, wherein a plurality of successive finishing operations are required to complete the garments. The operations are done at different locations on the blanks and may apply, for example, to forming hems or attaching garment parts such as reinforcing tapes, sleeves, etc. to different sections of the garments. For purposes of efficiency, garment finishing operations are typically conducted at discrete stations along a production line. In this manner, the sewing equipment, supplies and the like needed to best accomplish the respective operation are all available to the operator.

The invention is illustrated in connection with the production of tee shirts. Production of tee shirts begins with a tubular blank, for example of knit material. The blank is cut for length and to form the openings that will become the neck opening and the arm openings. The blank is hemmed at one end (the bottom) and through a series of seam forming and part attaching steps, is provided with arms, closed shoulders and a reinforced neck opening. As shown in FIG. 1, the blanks 30 are processed through a plurality of these steps when attached in a stack 20, by means of a common fastener in the form of clip 70. Clip 70 includes an attachment apparatus 74, by which the clip (and thus the stack 20 of blanks 30) are carried from station to station.

The stack is preferably formed in connection with a first step or at least an early step in the manufacturing process. The initial sewing step, conducted after the blanks have been cut, is illustrated in FIG. 2. A blank 30 is provided with a hem 36 at its open end or bottom, i.e., the end opposite from the end having the neck opening 42 and arm openings 44 cut therein. The hem can be made using a special form of hem forming sewing machine, e.g., adapted to form blind stitches. The folded over width of the hem is to be disposed on the inside of the tee shirt in the finished product. Subsequent attachment steps are accomplished by sewing steps on the inside of the shirt as well. Accordingly, the shirt is inverted, i.e., turned inside out and hung on the conveyor upside down at this stage in the process.

An operator at the hemming station performs only this hemming operation on each successive shirt, stacking a plurality of the blanks in registry when this initial operation is completed, then fastening the stack in a unit and placing it on the overhead conveyor.

In the stack, corresponding locations of the tee shirts or other successive garments are disposed over one another. All the neck openings are placed over one another and all the shoulder openings are placed over one another, etc. The stacks can be conveniently formed in groups of ten or twelve blanks, whereupon the operator attaches the blanks in position by fastening them together via clip 70. For subsequent steps in the operation, it is not necessary for operators performing later functions in the process to find a point of reference on each blank handled, or to position and arrange each of the individual blanks. Instead, the entire stack is positioned, and each individual blank, when folded over into position for sewing, is inherently referenced to the needed position of the blank for that sewing operation. Each completed blank is folded back or pushed aside after the operation thereon, for access to the next individual blank. In this manner, and as shown in FIG. 3, the blank is provided with a closed collar with an attached collar band 52, sewn shoulders 54 with shoulder tapes 56 reinforcing the same, and sleeves 46, which may have hems 48 thereon, all these being done via successive steps along the production line.

The garments are carried in the stack from processing station to processing station using a conveyor adapted to transport the stacks as units. The fastener 70 has means 74 for receiving a transporting mechanism, whereby the garments in the stack remain in registry during transport as well as during the processing operations. As shown in FIG. 4, successive stacks 20, carried by clips 70 which fasten the stack together and engage the conveyor, are transported via overhead conveyor 90. Conveyor 90 has engagement apparatus 92 and means (not shown) for driving a trolley from which the engagement apparatus protrudes, around a conveyor path passing by each finishing station 60 in turn. Preferably, the conveyor frictionally engages the trolley or engagement apparatus 92, and the operator can be provided with a controllable gate mechanism 98 for stopping the stacks from passing by. The stacks therefore queue up to each processing station by operation of the conveyor 90, and wait until the operator at the station detaches a clip to process the garment blanks in the stack. The individual processing stations can include one operator workstation or a plurality of operators and/or workstations.

The transporting mechanism is subject to some variation. An overhead conveyor having an endless path and allowing articles suspended from the conveyor to queue is available from the Swedish company ETON, and is known as a transport rail. The conveyor can be provided with various circuitous paths, changes in elevation and the like, which have not been illustrated. The path can be arranged to follow whatever path leads conveniently from one station to a successive station in the logical succession of operations. Changes in elevation can be used, for example to bring the stacks down within easy reach of the operator, who typically sits down at the sewing station 60, and to raise the stacks in the area of aisles, or to clear machinery, etc.

At each station along the route of the conveyor, at least one operation is conducted on the blanks. The stack 20 is placed in position adjacent the sewing machine 120 at the station 60. Beginning with an endmost blank in the stack, i.e., the top or bottom blank, the finishing operation is performed on the blank 62, which blank is then turned back over the stack or pushed clear of the sewing machine working zone for access to the next. The same finishing operation is then performed on a next endmost blank, repeating the clearing (e.g., turning back) of the currently endmost blank and after it has been operated upon and repeating the same finishing operation on each of the successive blanks, said blanks remaining attached in the stack by the fastener 70. It is not necessary for the operator to position each blank to find the correct end or side, because all the blanks are fixed to place their respective portions in registry. The operator need only access, finish and clear the successive individual blanks in turn.

Upon completing the particular finishing operation on each of the blanks in the stack, the operator places the stack back on conveyor 90, by attaching the affixing means 74 of clip 70 to the engagement apparatus 92 of conveyor 90, and extracts from the conveyor the next stack for finishing. The already completed stack is transported to a next finishing station where, in the same manner as described, the next finishing operation is completed, i.e., on an endmost blank, which is then turned back or pushed clear, continuing for each of the successive blanks and for a plurality of the different locations on the garment, until competed. During this entire operation, the stack is retained by the fastener.

The hemming of the blanks is a convenient step to use for assembling the blanks in a stack because hemming involves rotation of the blank during the hem forming sewing step, the hem extending circularly around the open bottom end of the shirt. It would not be practical to rotate the entire stack when forming the hem on the individual blanks therein. Furthermore, forming the hem is the only operation done on the bottom of the blanks, the remaining operations being performed at or near the opposite end. By first forming the hem and attaching the clip 70 to the reinforced edge defined by the hem, the subsequent operators along the way are provided with the greatest freedom of movement for conducting operations at the opposite end. Clipping at an extreme end or the blanks (preferably the bottom hem end) also allows the shirts to drop easily into registry due to gravity when the clip is again suspended from the conveyor 90 at the end of stack processing at a station. For all these reasons, the hem is advantageously formed first and the clip is attached at the hem, i.e., a clear endmost location on the blanks.

It is not absolutely necessary to attach the clip at the bottom hem or to perform the hem forming operation first. The blanks can be stacked as a separate preliminary step and the clip attached, for example along a side of the garment blank, preferably well clear of the area in which further processing steps are performed (i.e., clear of the shoulder end of the blank). Preferably, however, the stacking step is associated with a first or early processing step, the invention thus comprising conducting a preliminary finishing operation on each of the blanks prior to said stacking step, whereby the stacking operation does not require an additional operator and/or processing station.

The complete processing of blanks 30 into finished tee shirts 40 includes steps associated with hemming the blanks, forming and attaching a collar to each of the blanks and attaching sleeves to the blanks. These steps are illustrated in FIGS. 4 and 5, which show processing stations laid out for the successive operations. A supply of tee shirt blanks 30 are brought to the initial station 116, at which hemming, stacking and clipping are accomplished. As shown in the drawing the blanks 30 can be provided initially in a disorganized group, e.g., in a bin 114, however, they could also be transported to the area via a conveyor or other convenient means. Initial station 116 can be located in the area of an accessway 112 of the facility, whereby the arriving materials need not be moved through the production area to be brought to the initial station. The production area is arranged in a loop, whereby the finished products 40 at the final station 138 likewise arrive at the area 112 of easy access.

Initial station 116 includes a hem forming sewing machine 120, which under operator control engages the bottom edge of each blank fed into the sewing machine and forms a hem, rotating the blank in the process. The operator inverts each blank after the hem is formed, and stacks the hemmed blanks in registry, i.e., aligning the hemmed blanks such that all the neck holes, arm areas, shoulders and edges are disposed directly over one another in the stack. A guide bar 122 in the form of a raised corner on the work area of station 122 can be provided to assist the operator of the initial station 116 in accurately aligning the blanks. It is convenient to handle the blanks as well as the finished shirts in dozens. Accordingly, twelve blanks are stacked and then clip 70 is attached at a central area of the hemmed end. The initial station operator then places the integrally attached stack onto overhead conveyor 90, which moves counter clockwise in FIG. 5.

The overhead conveyor can be an ETON transport rail conveyor or the like, having a plurality of carriages or trolleys which move independently of one another around the circuit defined by the conveyor, each of the carriages having an engagement apparatus 92, which receives the clip 70 at its attachment apparatus 74. In FIG. 1, the attachment apparatus on the clip is shown generally as an eye and in FIG. 4 the conveyor engagement apparatus is shown as a hook. It will be appreciated that these particular structures can be varied as convenient. For example both can be hooks, the hook-eye relationship can be reversed, or another easily detachable connection structure can be employed.

Figure 6:
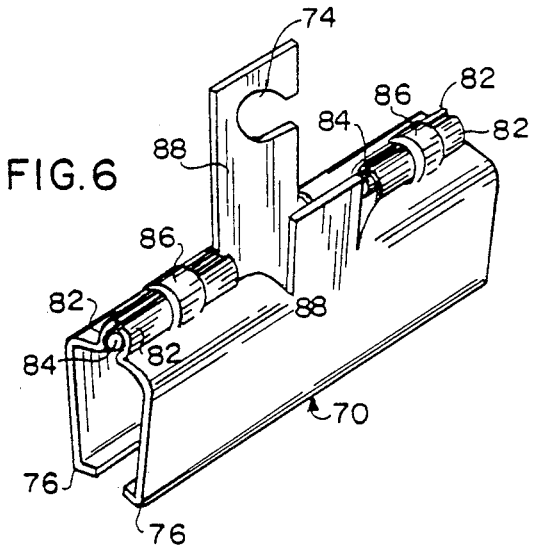

FIG. 6 illustrates a possible form of spring clip 70, which in this embodiment is generally similar to spring clips used to attach sheafs of paper, although larger, as appropriate for attaching tee shirts. The spring clip has opposed jaw portions 76, which bear resiliently inward toward one another, and can be separated against spring pressure, for example by means of protruding tabs 88, attached to or integral with the jaws. One or both of the tabs 88 includes a hook or eye structure 74, by which the clip and the stack attached thereto are detachably placed on one of the carriages of overhead conveyor 90. The jaws 76 can be integral parts of a single piece of spring metal or plastic, being simply bent resiliently open when affixing the clip 70 to the stack, and allowed to relax such that the jaws come resiliently together. Alternatively, as shown in FIG. 6, the two jaws 76 together with their tabs 88 can be separate pieces, hinged to one another by partial channels 82, with hinge pins 82 therein. The hinge leaves are affixed by springs 86, defining U-shapes, providing the spring bias urging the clips to close. Other forms of clips can also be used.

The blanks are transported to each finishing station 126, 128, 132, 134 using the overhead conveyor 90 as the transporting mechanism. At each finishing station the stacks queue up and await detachment from conveyor 90 by the operator. Upon detachment, the operator uses sewing machine 120 at the respective station to conduct a finishing operation, the stations 126, 128, 132, 134 each being outfitted for conducting one of a plurality of successive finishing operations efficiently. As described with respect to FIG. 4, the operation is conducted on an endmost tee shirt blank in the stack while the stack remains integrally attached via clip 70. The finished endmost blank is pushed clear or turned back for conducting the same the finishing operation on a next endmost blank in the stack, repeating this operation for each of the successive tee shirt blanks in turn, said tee shirt blanks remaining attached by said fastener such that each blank is found by the operator in the same relative position. There is no need to find the location to be processed individually for each blank in turn before the finishing operation can be commenced. When the stack is complete it is transported to the next finishing station, and so on until completion of the plurality of successive finishing steps.

The individual tee shirt blanks become misaligned as the operators push them clear after an operation, for access to the next blank in the stack. However, fastener 70 remains attached to the tee shirt blanks at an end of the stack. As a result, when a completed stack is suspended from conveyor 90 during transport to the next station, the tee shirt blanks in the stack become realigned naturally into registry due to gravity.

In the preferred layout shown, operator station 126 closes the shoulder end to form a collar on the blank; station 128 attaches a reinforcing collar band; station 132 sews the shoulders, attaching a shoulder tape on the outer surface (the blanks being inside-out after inversion at initial station 116). Station 134 attaches the sleeves, which can be supplied via bin 136, and station 138 packs the finished shirts 40, for example in boxes 140. Either at final sewing station 134 or at the packing station 138, the clips 70 are removed from the stack and the finished shirts are turned right-side out and inspected. In this manner, continuous production of tee shirts proceeds, and it is not necessary for the operators at each of the sewing stations to realign the individual blanks to their respective machines prior to commencing sewing, because the preliminary alignment of the blanks, and the positive retention of this alignment via clip 70 throughout processing, enable all the subsequent operators to benefit from the preliminary alignment step performed at initial station 116.

The invention having been disclosed, a number of variations within the scope of the invention will now become apparent to persons skilled in the art. Reference should be made to the appended claims rather than the foregoing specification in order to assess the scope of the invention in which exclusive rights are claimed.

I claim:

1. An improved method for manufacturing garments from blanks, in a process including a plurality of successive finishing operations of which individual said finishing operations are conducted on respective locations on the blanks to form the garments, the method comprising:

stacking a plurality of said blanks in registry with corresponding ones of the respective locations of successive blanks disposed over one another in a stack;

attaching to the stack a fastener having means for receiving a transporting mechanism, whereby the blanks in the stack remain in registry;

transporting the stack to a finishing station using the transporting mechanism;

conducting one of said finishing operations on an endmost blank in the stack;

clearing said endmost blank and conducting the same said finishing operation on a next endmost blank, repeating said clearing of said next endmost blank and repeating said finishing operation on each of the successive blanks, said blanks remaining attached by said fastener;

transporting the stack to a next finishing station and conducting a next finishing operation on an endmost blank, clearing said endmost blank and continuing said next finishing operation on each of the successive blanks, the blanks remaining attached by the fastener;

repeating said transporting and conducting of the finishing operations for each of the successive blanks at a plurality of said respective locations on the blank, while retaining the stack in the fastener at least until completion of said plurality of successive finishing operations.

2. An improved method for manufacturing garments from blanks, in a process including a plurality of successive finishing operations of which individual said finishing operations are conducted on respective locations on the blanks to form the garments, the method comprising:

conducting a preliminary finishing operation on each of the blanks, and stacking a plurality of said blanks in registry with corresponding ones of the respective locations of successive blanks disposed over one another in a stack;

attaching to the stack a fastener having means for receiving a transporting mechanism, whereby the blanks in the stack remain in registry, the fastener being attached to the blanks in the stack at a location on the blanks finished during said preliminary finishing operation;

transporting the stack to a finishing station using the transporting mechanism;

conducting one of said finishing operations on an endmost blank in the stack;

clearing said endmost blank and conducting the same said finishing operation on a next endmost blank, repeating said clearing of said next endmost blank and repeating said finishing operation on each of the successive blanks, said blanks remaining attached by said fastener;

transporting the stack to a next finishing station and conducting a next finishing operation on an endmost blank, clearing said endmost blank and continuing said next finishing operation on each of the successive blanks, the blanks remaining attached by the fastener;

repeating said transporting and conducting of the finishing operations for each of the successive blanks at a plurality of said respective locations on the blank, while retaining the stack in the fastener at least until completion of said plurality of successive finishing operations.

3. The method of claim 1, further comprising conducting a preliminary finishing operation on each of the blanks prior to said stacking step, the preliminary finishing operation including hemming along at least one finished edge and wherein the fastener is attached to the stack to engage said finished edge in said attaching step.

4. An improved method for manufacturing garments from blanks, in a process including a plurality of successive finishing operations of which individual said finishing operations are conducted on respective locations on the blanks to form the garments, the method comprising:

stacking a plurality of said blanks in registry with corresponding ones of the respective locations of successive blanks disposed over one another in a stack;

attaching to the stack a fastener having means for receiving a transporting mechanism, whereby the blanks in the stack remain in registry;

transporting the stack to a finishing station using the transporting mechanism;

conducting one of said finishing operations on an endmost blank in the stack;

clearing said endmost blank and conducting the same said finishing operation on a next endmost blank, repeating said clearing of said next endmost blank and repeating said finishing operation on each of the successive blanks, said blanks remaining attached by said fastener;

transporting the stack to a next finishing station and conducting a next finishing operation on an endmost blank, clearing said endmost blank and continuing said next finishing operation on each of the successive blanks, the blanks remaining attached by the fastener;

repeating said transporting and conducting of the finishing operations for each of the successive blanks at a plurality of said respective locations on the blank, while retaining the stack in the fastener at least until completion of said plurality of successive finishing operations, and wherein the blanks are tee shirt blanks and the finishing operations include at least some of the steps of hemming the blanks, attaching a collar to each of the blanks and attaching sleeves to the blanks.

5. The method of claim 1, wherein the transporting mechanism includes an overhead conveyor and the transporting step includes moving the blanks in a stack from one finishing station to a next finishing station on the overhead conveyor, the blanks being maintained in registry by the fastener during the transporting step and arriving at the next finishing station while still held in registry by the fastener, whereby it is unnecessary to re-orient individual ones of the blanks in order to effect a finishing operation at said next finishing station.

6. An improved method for manufacturing garments from blanks, in a process including a plurality of successive finishing operations of which individual said finishing operations are conducted on respective locations on the blanks to form the garments, the method comprising:

conducting a preliminary finishing operation on each of the blanks, the preliminary finishing operation including hemming along at least one finished edge;

stacking a plurality of said blanks in registry with corresponding ones of the respective locations of successive blanks disposed over one another in a stack;

attaching to the stack a fastener having means for receiving a transporting mechanism, whereby the blanks in the stack remain in registry, the fastener being attached to the stack to engage said finished edge in said attaching step;

transporting the stack to a finishing station using the transporting mechanism;

conducting one of said finishing operations on an endmost blank in the stack;

clearing said endmost blank and conducting the same said finishing operation on a next endmost blank, repeating said clearing of said next endmost blank and repeating said finishing operation on each of the successive blanks, said blanks remaining attached by said fastener;

transporting the stack to a next finishing station and conducting a next finishing operation on an endmost blank, clearing said endmost blank and continuing said next finishing operation on each of the successive blanks, the blanks remaining attached by the fastener;

repeating said transporting and conducting of the finishing operations for each of the successive blanks at a plurality of said respective locations on the blank, while retaining the stack in the fastener at least until completion of said plurality of successive finishing operations, and wherein the blanks are tee shirt blanks and the finishing operations include at least some of the steps of hemming the blanks, attaching a collar to each of the blanks and attaching sleeves to the blanks.

7. The method of claim 6, wherein the preliminary finishing step also includes turning the tee shirt blanks inside out, said finishing operations being conducted on an inside of the tee shirt blanks as thereby turned out, and further comprising a final step including removing the fastener from the stack and again turning the tee shirt blanks inside out to provide a group of finished tee shirts.

8. A process for manufacturing tee shirts from tubular blanks having bottom ends and shoulder ends, the process comprising:

stacking a plurality of said tubular blanks in registry with corresponding bottom ends and shoulder ends of successive tubular blanks disposed over one another in a stack;

attaching to the stack a fastener having means for receiving a transporting mechanism, whereby the tee shirt blanks in the stack are fixed in registry;

transporting the stack to a finishing station using the transporting mechanism;

conducting one of a plurality of successive finishing operations on an endmost tee shirt blank in the stack;

clearing said endmost tee shirt blank and conducting the same said one of the plurality of finishing operations on a next endmost tee shirt blank in the stack, repeating said clearing of said next endmost tee shirt blank and repeating said finishing operation on each of the successive tee shirt blanks in turn, said tee shirt blanks remaining attached by said fastener;

transporting the stack to a next finishing station and conducting a next one of the plurality of successive finishing operations on an endmost tee shirt blank, clearing said endmost tee shirt blank and continuing said next finishing operation on each of the next successive tee shirt blanks in the stack in turn, the tee shirt blanks remaining attached by the fastener;

repeating said transporting and conducting of the plurality of successive finishing operations for each of the successive tee shirt blanks, retaining the stack in the fastener at least until completion of said plurality of successive finishing operations.

9. The process of claim 8, wherein the fastener is attached to the tee shirt blanks at an end, and the stack is suspended from a conveyor during the transporting step, whereby the tee shirt blanks in the stack become realigned in registry due to gravity when the stack is transported.

10. The process of claim 8, further comprising a preliminary finishing step including hemming the tee shirt blanks along at least one finished edge, the fastener being attached at said finished edge.

11. The process of claim 10, wherein said successive finishing steps include forming on the tee shirt blanks a collar, shoulders and sleeves.

12. The process of claim 10, wherein the preliminary finishing step further comprises turning the tee shirt blanks inside out.

13. The process of claim 12, wherein the successive finishing steps include forming on the inside out tee shirt blanks a collar, shoulders and sleeves.

14. The process of claim 13, wherein forming the collar and shoulders includes attaching a tape to the tee shirt blanks.

15. The process of claim 14, further comprising a final step including removing the fastener and again turning the tee shirt blanks inside out.

16. The method of claim 4, wherein the transporting mechanism includes an overhead conveyor and the transporting step includes moving the blanks in a stack from one finishing station to a next finishing station on the overhead conveyor.

* * * * *